United States Patent [19]

Bassett et al.

[11] 4,428,504

[45] Jan. 31, 1984

[54] DUAL-FUNCTION CARGO DISCHARGE APPARATUS

[75] Inventors: Noel L. Bassett, Grand Island, N.Y.; Henry R. King, Sturgeon Bay, Wis.

[73] Assignees: American Steamship Company, Buffalo, N.Y.; R. A. Stearn, Inc., Sturgeon Bay, Wis.

[21] Appl. No.: 326,669

[22] Filed: Dec. 2, 1981

[51] Int. Cl.[3] ..... B65G 65/02

[52] U.S. Cl. ..... 222/55; 222/461; 222/545; 222/559; 277/34; 105/247; 105/280; 198/532; 414/144

[58] Field of Search ..... 222/461, 504, 545, 559, 222/55; 414/145, 144, 292; 198/524, 530, 532; 105/287, 280, 239, 247; 277/34

[56] References Cited

U.S. PATENT DOCUMENTS

| | | | |
|---|---|---|---|
| 2,785,824 | 3/1957 | Reeves | 277/34 |
| 3,185,346 | 5/1965 | Loveall, Jr. et al. | 222/55 |
| 3,191,998 | 6/1965 | Howlett | 414/144 X |
| 3,198,386 | 8/1965 | Hartley | 222/56 X |
| 3,224,382 | 12/1965 | Floehr | 222/512 |
| 3,489,296 | 1/1970 | Snow | 414/144 |
| 3,927,758 | 12/1975 | Greyor | 198/524 |
| 3,940,152 | 2/1976 | Fournier | 277/34 |
| 3,990,588 | 11/1976 | Dibben | 414/144 |
| 3,997,089 | 12/1976 | Clarke et al. | 222/545 |
| 4,004,700 | 1/1977 | Empey | 414/144 |

FOREIGN PATENT DOCUMENTS

| | | | |
|---|---|---|---|
| 300367 | 9/1965 | Netherlands | 198/530 |
| 630172 | 9/1978 | U.S.S.R. | 222/545 |

*Primary Examiner*—Robert J. Spar
*Assistant Examiner*—Ken Muncy
*Attorney, Agent, or Firm*—Emrich & Lee and Brown, Hill, Dithmar, Stotland, Stratman & Levy

[57] ABSTRACT

In a self-unloading vessel having hoppers with discharge outlets for discharging either lump or pulverulent material onto an unloading conveyor, discharge apparatus includes a wheeled carriage supporting two separate gate assemblies thereon and movable to bring one or the other of the gate assemblies into discharge relationship with the hopper outlet. One gate assembly includes a horizontally sliding gate which is driven between open and closed positions by a drive cylinder. The other gate assembly includes fluidized bed airslide apparatus for directing pulverulent material to a discharge passage closed by a butterfly valve. Two embodiments are disclosed. In one a separate drive cylinder is provided for moving the carriage between its two positions along associated rails. In the other the one gate can be releaseably pinned to the other gate assembly. The relative positions of the two gate assemblies are reversed in the two embodiments.

27 Claims, 12 Drawing Figures

140
142
17
163
120
36
32
123
35
43
19
11.
141
133
40
163
134
135
132
131
110
158
150
161
152
157
127
129
128

37
39
110
121
124
122
38
140
143
141
115
26
32
144
40
130
18
154
116
153
156
160
10.
159
117
155
16
43
151
35
163
126
125
17

DUAL-FUNCTION CARGO DISCHARGE APPARATUS

BACKGROUND OF THE INVENTION

The present invention relates to a dual cargo vehicle, that is, a vehicle which selectively may be converted for the shipment and discharge of different types of material, and particularly to a ship or similar vessel which may selectively be converted for the transport and discharge of pulverulent materials, such as cement, and material in lump form such as coal or ore. The present invention is particularly related to such dual cargo vessels which are provided with hoppers having bottom discharge outlets.

One such dual cargo vessel is disclosed in U.S. Pat. No. 3,191,998, issued to Charles L. Howlett on June 29, 1965. That patent discloses an unloading system which includes two unloading conveyors in the bottom of the vessel, viz., a screw-type conveyor for unloading pulverulent material and a belt-type conveyor for unloading lump material, the two conveyors being arranged in side-by-side relationship. The system also includes two different and independently mounted discharge gates for discharging different types of material from the hopper outlets. For discharging lump-type material to the belt conveyor, a tilt gate is mounted on a carriage for movement between open and closed positions with respect to the associated hopper outlet. When it is desired to discharge pulverulent material to the screw conveyor, the tilt gate is moved by pneumatic means entirely out of the way to accommodate movement of an airslide and chute unloading arrangement into position beneath the hopper outlet.

Thus, in that prior art system the two different discharge assemblies are completely independent of each other. Two separate and independent mounting and drive assemblies are provided respectively for the two discharge assemblies, and they are adapted for discharge respectively into two separate and independent unloading conveyors. This duplication results in an extremely complex and expensive system which occupies a considerable amount of space in the vessel.

SUMMARY OF THE INVENTION

It is a general object of this invention to provide an improved discharge apparatus for a dual cargo vessel which avoids the disadvantages of prior art apparatus, while affording additional structural and operating advantages.

An important object of this invention is the provision of a dual-function discharge apparatus which is of relatively simple and economical construction and is characterized by simplicity of operation.

Another object of this invention is to provide a dual-function discharge apparatus which includes two different discharge assemblies movable in tandem by a single drive mechanism between positions for respectively bringing the discharge assemblies into operative relationship with an associated hopper.

It is another object of this invention to provide discharge apparatus of the type set forth, wherein both discharge assemblies are adapted for controlling discharge of material to a single unloading conveyor.

These objects are attained by providing discharge apparatus for discharge of lump as well as pulverulent material from a hopper having a discharge outlet, said discharge apparatus comprising a carriage mounted adjacent to the hopper outlet and movable between first and second positions, first gate means mounted on the carriage and adapted for handling lump material, second gate means mounted on the carriage and adapted for handling pulverulent material, the first gate means being disposed for cooperation with the hopper outlet to control the discharge of lump material therefrom when the carriage is disposed in the first position thereof, the second gate means being disposed for cooperation with the hopper outlet to control the discharge of pulverulent material therefrom when the carriage is disposed in the second position thereof, and drive means coupled to the carriage for effecting movement thereof between the first and second positions thereof.

The invention consists of certain novel features and the combination of parts hereinafter fully described, illustrated in the accompanying drawings, and particularly pointed out in the appended claims, it being understood that various changes in the details may be made without departing from the spirit, or sacrificing any of the advantages, of the invention.

DESCRIPTION OF THE PREFERRED EMBODIMENTS

Figure 1:
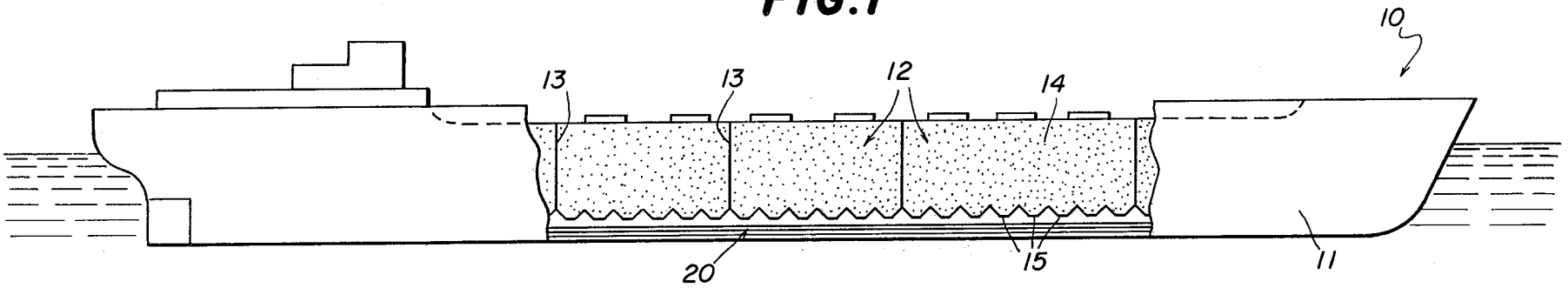
FIG. 1 is a side elevational view of a dual-cargo vessel of the type with which the present invention is to be used, with a portion of the vessel broken away more clearly to illustrate the cargo holds and discharge hoppers therein.

In FIG. 1 there is illustrated a self-unloading vessel, generally designated by the numeral 10, which comprises a ship having a hull 11 provided with a plurality of cargo holds 12 therein, separated by bulkheads 13 and adapted for carrying therein lading or cargo 14. More specifically, the vessel 10 is of the type which is adapted for carrying different types of cargo 14 in its cargo holds 12, e.g., dry pulverulent material such as bulk cement, or lump materials such as coal, ore or the like. Thus, different holds 12 of the vessel 10 may respectively carry pulverulent and lump material, or a single hold 12 may, at different times, carry pulverulent or lump cargoes.

Figure 2:
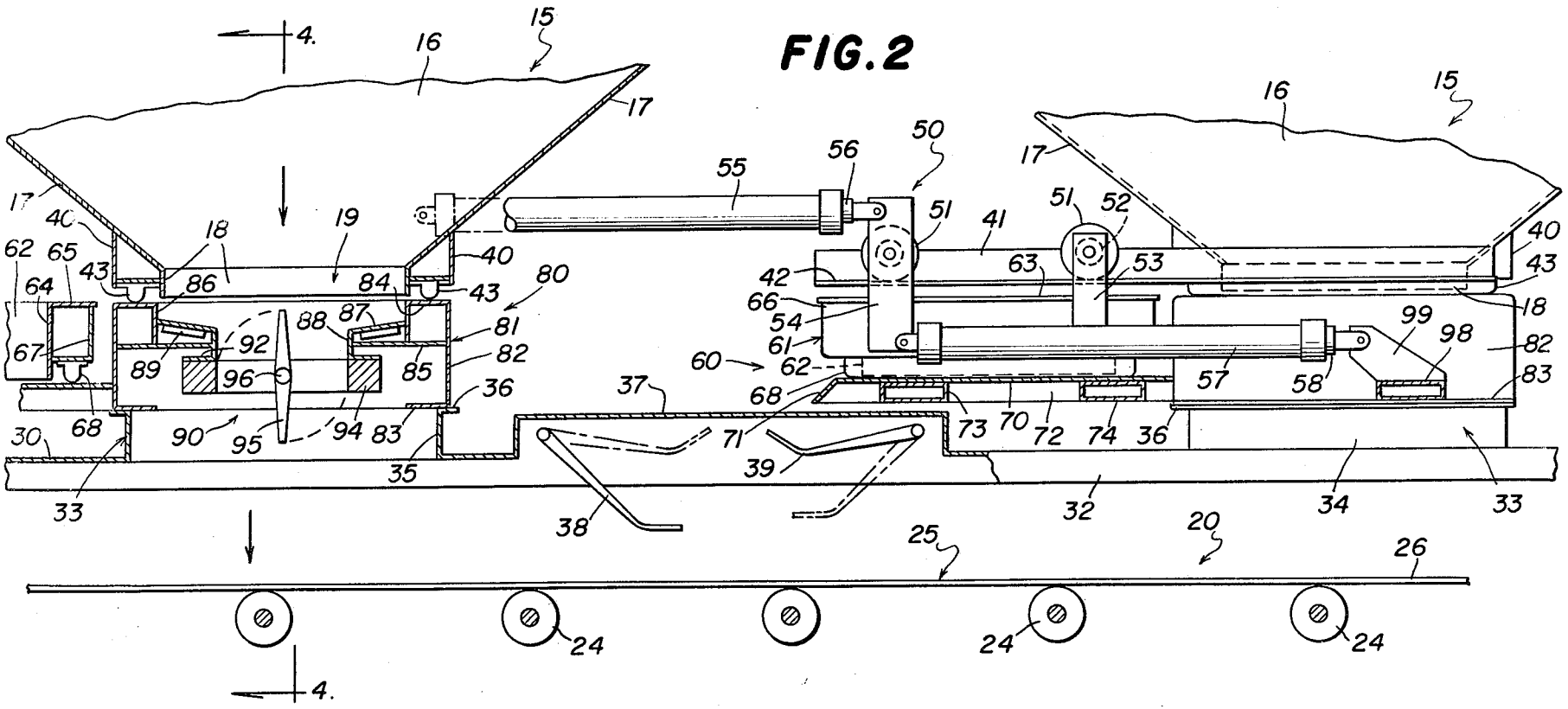
FIG. 2 is an enlarged fragmentary view, partially in side elevation and partially in vertical section, of two adjacent hopper outlets of the vessel of FIG. 1, each provided with a discharge apparatus constructed in accordance with and embodying the features of one embodiment of the present invention, and with the discharge apparatuses illustrated in position for discharging pulverulent material from the hoppers.
Figure 4:
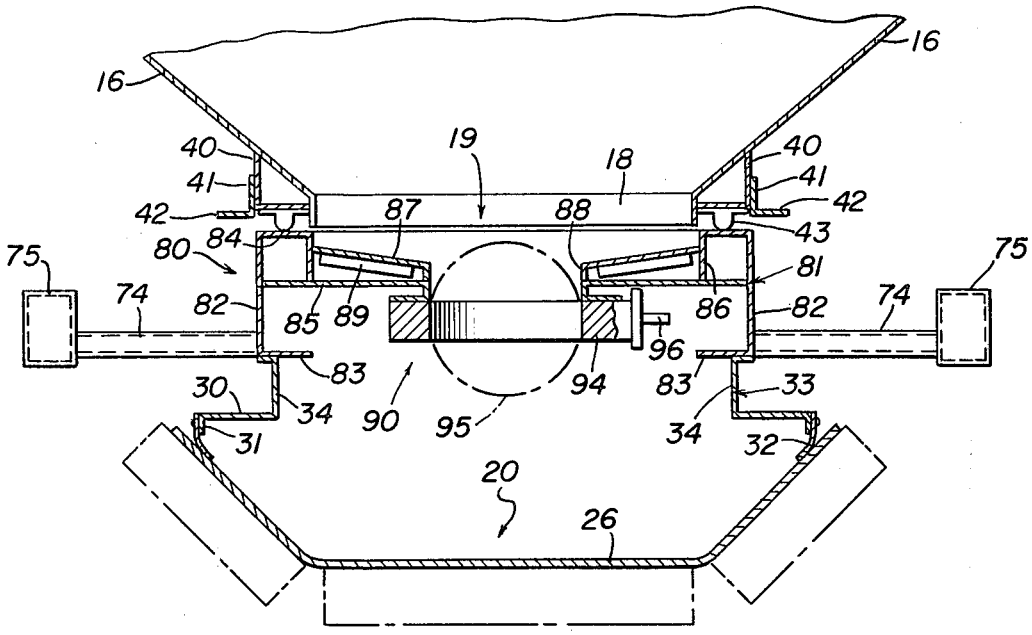
FIG. 4 is a fragmentary view in vertical section taken along the line 4—4 in FIG. 2.
Figure 5:
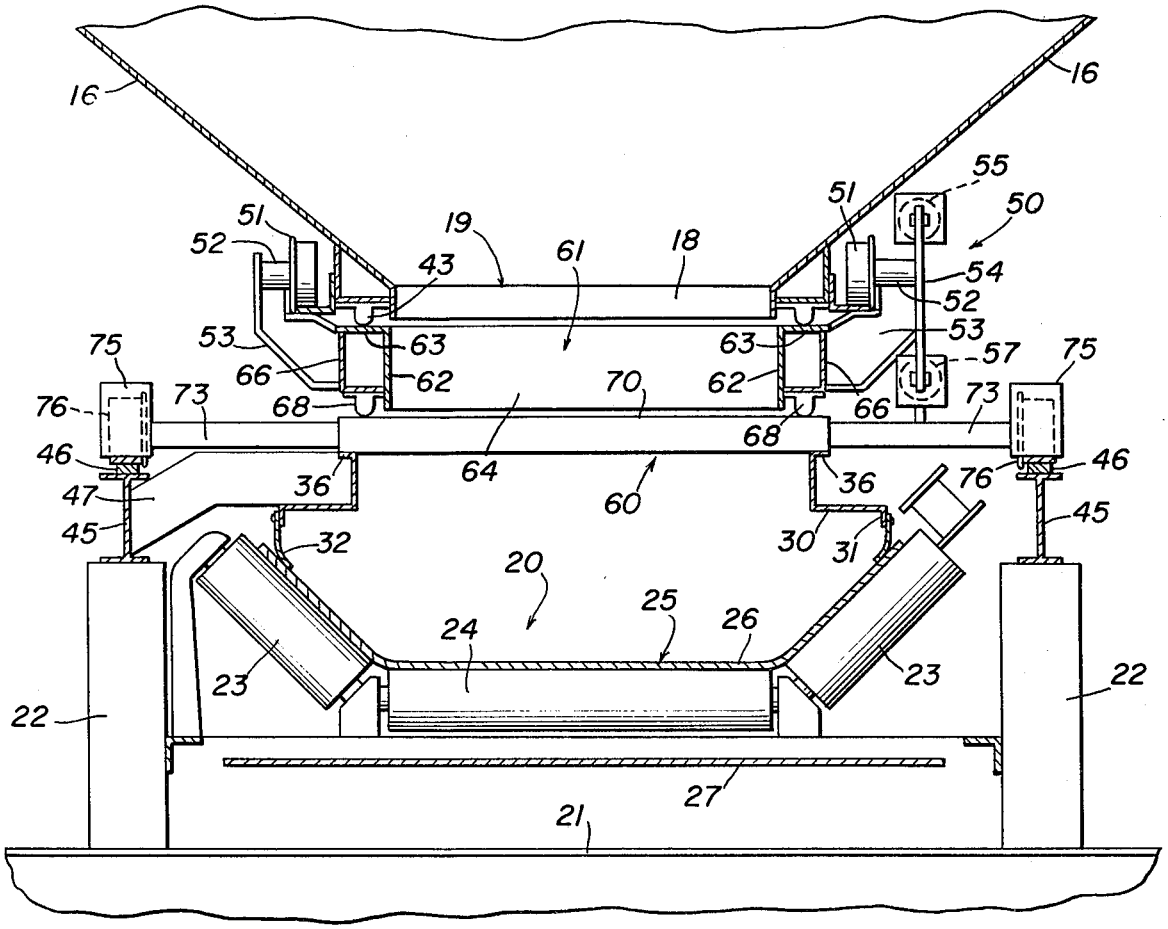
FIG. 5 is a fragmentary view in vertical section taken along the line 5—5 in FIG. 3.
Figure 6:
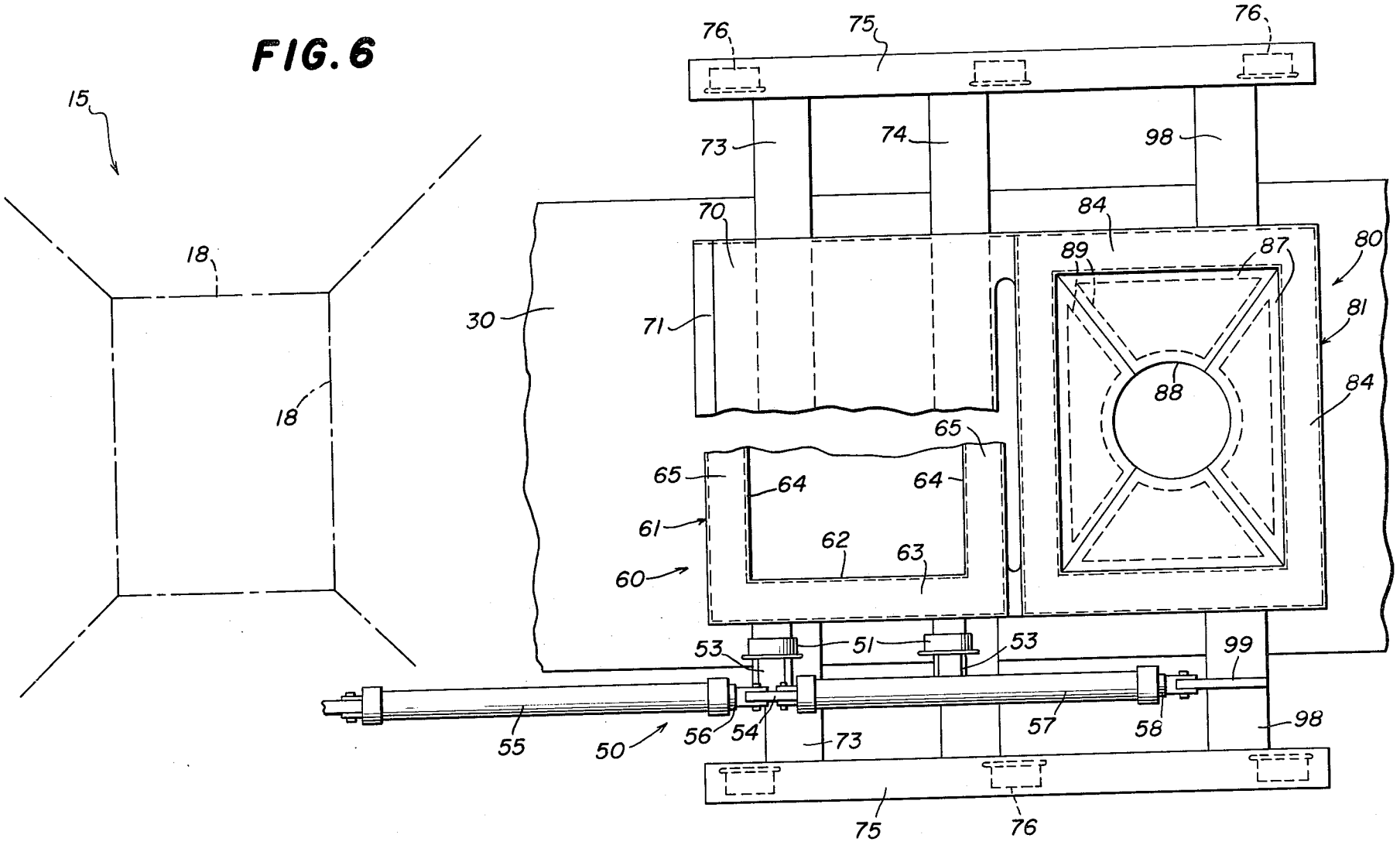
FIG. 6 is a fragmentary top plan view of the discharge apparatus of FIG. 2, with a portion of the lump material discharge assembly broken away more clearly to show the construction thereof.

Referring also to FIGS. 2 through 6, each of the holds 12 is provided with a plurality of hoppers 15 in the bottom thereof, each hopper 15 being substantially rectangular in horizontal cross section, including a pair of downwardly and inwardly sloping side walls 16 and a pair of opposed downwardly and inwardly sloping end walls 17, the walls 16 and 17 each being provided at the lower end thereof with a depending rectangular outlet flange 18, the flanges 18 being interconnected and cooperating to define a rectangular outlet 19 for the hopper 15 (see FIGS. 2 and 6). The hoppers 15 are aligned longitudinally of the vessel 10. If a single row of hoppers 15 is provided, they will be aligned along the midline of the vessel 10. However, it will be appreciated that the vessel 10 may be provided with plural rows of hoppers 15, each extending longitudinally of the vessel 10 on opposite sides of the center line thereof.

Underlying each such row of hoppers 15 is an unloading conveyor, generally designated by the numeral 20, which extends fore and aft of the vessel 10 and cooperates with associated off-loading apparatus (not shown) for unloading the cargo 14 from the vessel 10. The unloading conveyor 20 is preferably an endless belt-type conveyor and is supported on decking 21 at the bottom of the vessel 10. More specifically, parallel rows of support posts 22 are provided on which are supported a plurality of longitudinally spaced-apart sets of rollers, each set including a pair of inclined side rollers 23 and a horizontal center roller 24 (see FIGS. 4 and 5). Supported on the rollers 23 and 24 is the upper flight 26 of an endless conveyor belt 25, the return flight 27 of which is supported on idler rollers 28 (see FIG. 3).

Overlying the upper flight 26 of the conveyor belt 25 is a dust cover 30 provided along the lateral edges thereof with depending flanges 31, to which are respectively secured depending resilient skirts 32, disposed in overlapping engagement respectively with the lateral edges of the conveyor belt upper flight 26 for cooperation therewith to retain discharged material thereon and prevent accidental spillage from the sides thereof. The dust cover 30 has a plurality of rectangular inlet openings therein respectively disposed beneath and in vertical alignment with the discharge outlets 19 of the hoppers 15. Each of these inlet openings is surrounded by an upstanding inlet structure 33 having a pair of opposed side walls 34 and a pair of opposed end walls 35, each of the walls 34 and 35 being provided with an outwardly extending horizontal flange 36 at the upper end thereof (see FIG. 3).

The dust cover 30 also has a plurality of raised portions 37 between the hoppers 15, each raised portion 37 covering a level control paddle 38 and a level indicating paddle 39 which are pivotally mounted for engagement with the discharged material carried by the conveyor belt 25 (see FIG. 2). More specifically, the position of the level indicating paddle 39 is indicative of the level of lump material on the conveyor belt 25, so that an associated gate can be manually operated to maintain the proper depth. The level control paddle 38 automatically maintains the proper depth of pulverulent material on the conveyor belt 25 by actuating associated control mechanism (not shown) for controlling in a known manner the operation of associated discharge apparatus.

Each of the hopper walls 16 and 17 is provided at the lower end thereof with an elongated angle frame 40, which has one flange thereof extending vertically and secured to the outer surface of the associated hopper wall 16 or 17 and the other flange thereof extending horizontally and secured to the outer surface of the associated one of the outlet flanges 18. Each of the angle frames 40 disposed along the sides of the hopper 15 has fixedly secured to the vertical flange thereof the vertical flange of a rail angle 41, each rail angle 41 having a horizontal flange 42 which extends laterally outwardly (see FIGS. 4 and 5). Respectively fixedly secured to the horizontal flange of the angle frames 40 and depending therefrom are elongated inflatable seals 43 which cooperate to encompass the associated hopper outlet 19.

Figure 3:
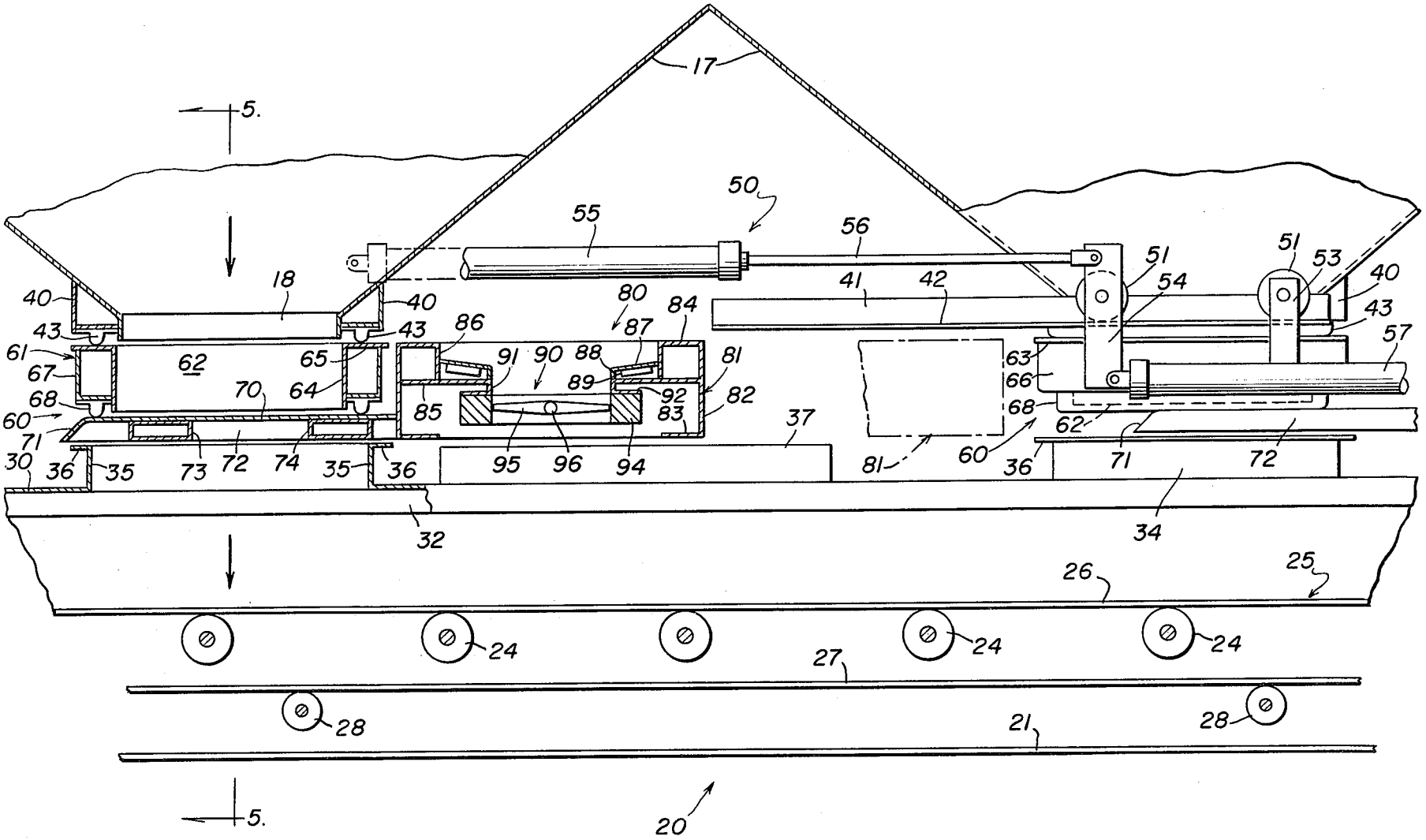
FIG. 3 is a view similar to FIG. 2, but illustrating the discharge apparatuses in position for discharging lump material from the hoppers.

In one embodiment of the invention, illustrated in FIGS. 2–6, each row of support posts 22 carries on the upper ends thereof an elongated I-beam 45, on the top of which is mounted an elongated rail 46 (see FIG. 5). Supported from the I-beams 45 and extending laterally inwardly therefrom are a plurality of support arms 47 for supporting the dust cover 30.

Associated with each of the hoppers 15 in the embodiment of FIGS. 2–6 is a gate carriage, generally designated by the numeral 50, which includes two pairs of flanged wheels 51 adapted for rolling engagement with the rail flanges 42. More particularly, each pair of flanged wheels 51 includes two coaxially arranged wheels respectively disposed for engagement with the two rail flanges 42. Each of the wheels 51 is rotatably mounted in a bearing 52 which is in turn connected to an associated support bracket 53 which extends downwardly beneath the associated rail flange 42, as is best illustrated in FIG. 5. Fixedly secured to the bearing 52 of one of the wheels 51 is an elongated vertically extending support plate 54 (see FIGS. 2 and 5), which has coupled to the upper end thereof a piston rod 56 of a pneumatically or hydraulically-actuated carriage drive cylinder 55 which is fixedly mounted on suitable support means (not shown). Coupled to the lower end of the support plate 54 is a pneumatically or hydraulically-actuated gate drive cylinder 57 which has a piston rod 58. While only one drive cylinder 55 is illustrated, two may be used, respectively coupled to the two bearings of a pair of the wheels 51.

Supported on the gate carriage 50 is a gate assembly, generally designated by the numeral 60, adapted for handling lump material. The gate assembly 60 includes a gate spacer 61 which has a pair of upstanding opposed side walls 62, each provided at the upper end with a laterally outwardly extending horizontal flange 63, and a pair of opposed end walls 64, each provided at the upper end thereof with an outwardly extending horizontal flange 65. The walls 62 and 64 are interconnected for defining a rectangular outlet passage. Each of the side walls 62 has associated therewith a side support angle 66 (see FIGS. 2 and 5), having one flange thereof disposed vertically and secured to the underside of the associated flange 63, and having the other flange thereof arranged horizontally and secured to the outer surface of the associated side wall 62. Similarly, each of the end walls 64 is provided with an end support angle 67 (see FIG. 3) having one flange thereof disposed vertically and secured to the underside of the associated flange 65 and having the other flange thereof disposed horizontally and secured to the outer surface of the associated end wall 64. The horizontal flange of each of the support angles 66 and 67 has secured thereto a depending elongated inflatable seal 68, the seals 68 cooperating to encompass the outlet end of the discharge passage through the gate spacer 61.

The support brackets 53 are fixedly secured to the side walls 62 for supporting the gate spacer 61 on the gate carriage 50 for movement therewith. More particularly, it will be appreciated that as the piston rod 56 is extended and retracted, the gate carriage 50 is moved back and forth along the rail flanges 42. The gate spacer 61 is so dimensioned that when the piston rod 56 is fully extended for disposing the gate assembly 60 beneath the associated hopper outlet 19, as illustrated in FIGS. 3 and 5, the flanges 63 and 65 of the gate spacer 61 are respectively disposed in sealing engagement with the inflatable seals 43 for providing a fluid-tight seal between the hopper 15 and the gate spacer 61.

The gate assembly 60 also includes a gate member 70 in the form of a flat rectangular plate disposed beneath the gate spacer 61. The gate member 70 is provided along the lateral edges thereof with short depending side flanges 72 and is provided at the front end thereof with an inclined end flange 71 (see FIGS. 2 and 3). Extending beneath the gate member 70 and fixedly secured thereto are two elongated, parallel support arms 73 and 74, spaced apart longitudinally of the gate member 70 and each in the form of a hollow member, rectangular in transverse cross section. The support arms 73 and 74 extend through complementary openings in the side flanges 72 and are fixedly secured at the ends thereof to two parallel support frames 75, respectively disposed on opposite sides of the associated hopper outlet 19 and extending longitudinally of the vessel 10 (see FIGS. 4–6). Rotatably carried by each of the support frames 75 is a plurality of flanged wheels 76 adapted for rolling engagement with an associated one of the rails 46 (see FIG. 5). The gate member 70 and the side flanges 72 are so dimensioned that in use the side flanges 72 are slidably engageable with the flanges 36 of the associated dust cover inlet structure 33, and the gate member 70 is disposed for sealing engagement with the inflatable seals 68 on the gate spacer 61, thereby cooperating with the inflatable seals 43 to maintain a fluid-tight separation of two cargo holds 12 from the unloading conveyor 20.

There is also provided a gate assembly, generally designated by the numeral 80, for handling pulverulent material. The gate assembly 80 has a housing 81 including four upstanding rectangular outer walls 82 interconnected in a rectangular configuration, two of the outer walls 82 extending longitudinally of the vessel 10 and the other two of the outer walls 82 extending laterally of the vessel 10. The forwardmost one of these laterally-extending walls 82 is fixedly secured to the rear end of the gate member 70 for movement therewith (see FIGS. 2 and 3). Each of the outer walls 82 is provided at the lower end thereof with an inwardly extending horizontal bottom flange 83 and is provided at the upper end thereof with an inwardly extending horizontal top flange 84. Also connected to each of the outer walls 82 intermediate the upper and lower ends thereof and extending inwardly therefrom is a horizontal attachment flange 85 which extends inwardly of the housing 81 well beyond the inner edges of the bottom and top flanges 83 and 84. Interconnecting the attachment flanges 85 and the inner edges of the top flanges 84 are upstanding inner walls 86.

Respectively secured to the inner walls 86 intermediate the upper and lower ends thereof and sloping downwardly and inwardly therefrom are airslide plates 87, which are preferably foraminous in nature. The inner edges of the attachment flanges 85 and the airslide plates 87 are arcuate (see FIG. 6) and are interconnected by a cylindrical member 88 which defines a discharge passage through the housing 81. It can be seen that the attachment flanges 85, the inner walls 86, the airslide plates 87 and the cylindrical member 88 cooperate to define a closed chamber which encompasses the discharge passage. Disposed in this chamber and respectively fixedly secured to the underside of each of the airslide plates 87 are plenum members 89 which are adapted for connection to an associated source of pressurized air (not shown) to cause a flow of air upwardly through the foraminous airslide plates 87 to provide a fluidized bed type of conveying mechanism in a well-known manner.

Mounted within the housing 81 is a valve assembly, generally designated by the numeral 90. More particularly, the cylindrical member 88 extends downwardly below the attachment flanges 85 and is provided at its lower end with a radially outwardly extending annular attachment flange 92. Fixedly secured to the attachment flange 92 and depending therefrom is an annular valve housing 94 in which a circular valve member 95 is rotatably mounted on a horizontal pivot shaft 96 to form a butterfly valve, which is rotatable between a fully open vertical position illustrated in FIG. 2 and a fully closed horizontal position illustrated in FIG. 3. Respectively fixedly secured to the longitudinally-extending ones of the outer walls 82 are two laterally outwardly extending support arms 98, each in the form of a hollow member rectangular in transverse cross section, and respectively fixedly secured at the outer ends thereof to the support frames 75. One of the support arms 98 has mounted thereon an upstanding coupling plate 99, which is in turn coupled to the piston rods 58 of the cylinder 57, (see FIGS. 2 and 6).

It will be appreciated that since the gate assembly 80 is fixedly secured to the gate member 70 and to the support frames 75, it will move in tandem with the gate member 70. Similarly, because the gate assembly 80 is connected to the gate spacer 61 via the cylinder 57, the support plate 54 and the associated one of the support brackets 53, it move in tandem with the gate spacer 61. Also, it will be appreciated that the support frames 75 and rails 46 cooperate with the support brackets 53 and rail flanges 42 to form the gate carriage 50 and support the gate assemblies 60 and 80. The housing 81 of the gate assembly 80 is so dimensioned that when it is disposed beneath the associated hopper outlet 19, the bottom flanges 83 will be respectively disposed in engagement with the flanges 36 of the associated dust cover inlet structure 33, and the top flanges 84 will be disposed in sealing engagement with the inflatable seals 43 (see FIGS. 2 and 4), thereby to maintain a fluid-tight separation of the cargo hold 12 from the unloading conveyor 20.

The operation of the discharge apparatus of the present invention will now be described in detail. When the cargo in the hopper 15 is pulverulent material, the gate carriage 50 is moved, by retraction of the piston rod 56 into the cylinder 55, to the position illustrated in FIGS. 2, 4 and 6, wherein the gate assembly 80 is positioned between the hopper outlet 19 and the associated dust cover inlet structure 33. More particularly, when the piston rod 56 is retracted, it operates through the support plate 54 and the associated support bracket 53 to move the gate spacer 61 to the left, as viewed in FIG. 2. The gate member 70 and the gate assembly 80 will move in tandem with the gate spacer 61 because of their interconnection with each other and their coupling to the gate spacer 61 via the cylinder 57. Thus, it will be appreciated that whenever the gate carriage 50 is moved back and forth along the associated rails 46 and rail flanges 42 by extension and retraction of the piston rod 56, the gate assemblies 60 and 80 will both move in unison.

It will be appreciated that the gate carriage 50 is moved to the position illustrated in FIGS. 2 and 4 prior to loading of the pulverulent material into the cargo hold 12 associated with the hopper 15, and the valve member 95 is initially disposed in its closed horizontal position. The closed valve assembly 90 and the sealing relationship between the housing 81 and the inflatable seals 43 serve to close the hopper outlet 19 and prevent escape of pulverulent material therefrom, as well as effectively preventing water or other fluids from being introduced thereinto. When it is desired to discharge pulverulent material from the hopper 15 to the unloading conveyor 20, pressurized air is introduced to the plenum members 89 and the valve member 95 is rotated from its closed position, it being understood that the rate of discharge will be controlled by the degree of opening of the valve assembly 90. The airslide plates 87 provide fluid-activated gravity-flow conveyors to facilitate the flow of pulverulent material to the discharge passage through the valve assembly 90.

When lump material is to be carried in the cargo hold associated with the hopper 15, the gate carriage 50 is moved by extension of the piston rod 56 to the position illustrated in FIGS. 3 and 5, wherein the gate assembly 60 is disposed between the hopper outlet 19 and the associated dust cover inlet structure 33. It will be appreciated that the closure of the discharge passage through the gate spacer 61 by the gate member 70, and the fluid-tight seal provided by the inflatable seals 43 and 68 serves effectively to close the hopper outlet 19 and prevent the escape of lump material therefrom, as well as effectively preventing water or other fluids from being introduced thereinto.

When it is desired to discharge the lump material from the hopper 15, the gate member 70 is moved toward the right, as viewed in FIG. 3 by extension of the piston rod 58. It will be appreciated that the rate of flow of lump material from the hopper 15 may be controlled by the degree of opening of the gate member 70, the gate member 70 being illustrated in a partially open position at the right-hand side of FIG. 3. Since the gate member 70 is connected to the gate assembly 80, as the gate member 70 is opened and closed, the gate assembly 80 will move with it. Thus, when the gate member 70 is disposed in its fully opened position, the housing 81 of the gate assembly 80 will be disposed in the position illustrated in broken line in FIG. 3.

Figure 9:
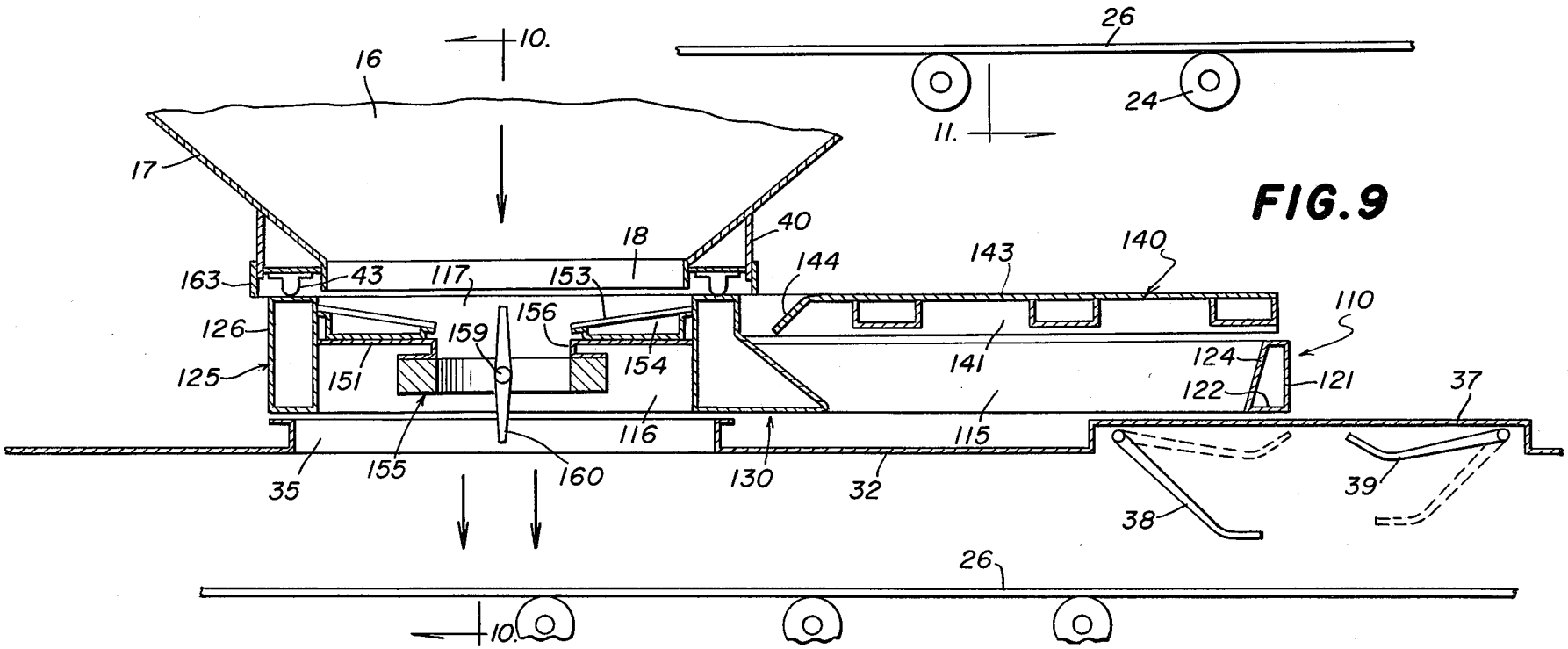
FIG. 9 is a view similar to FIG. 8 illustrating the discharge apparatus in position for discharging pulverulent material from the hopper.
Figure 10:
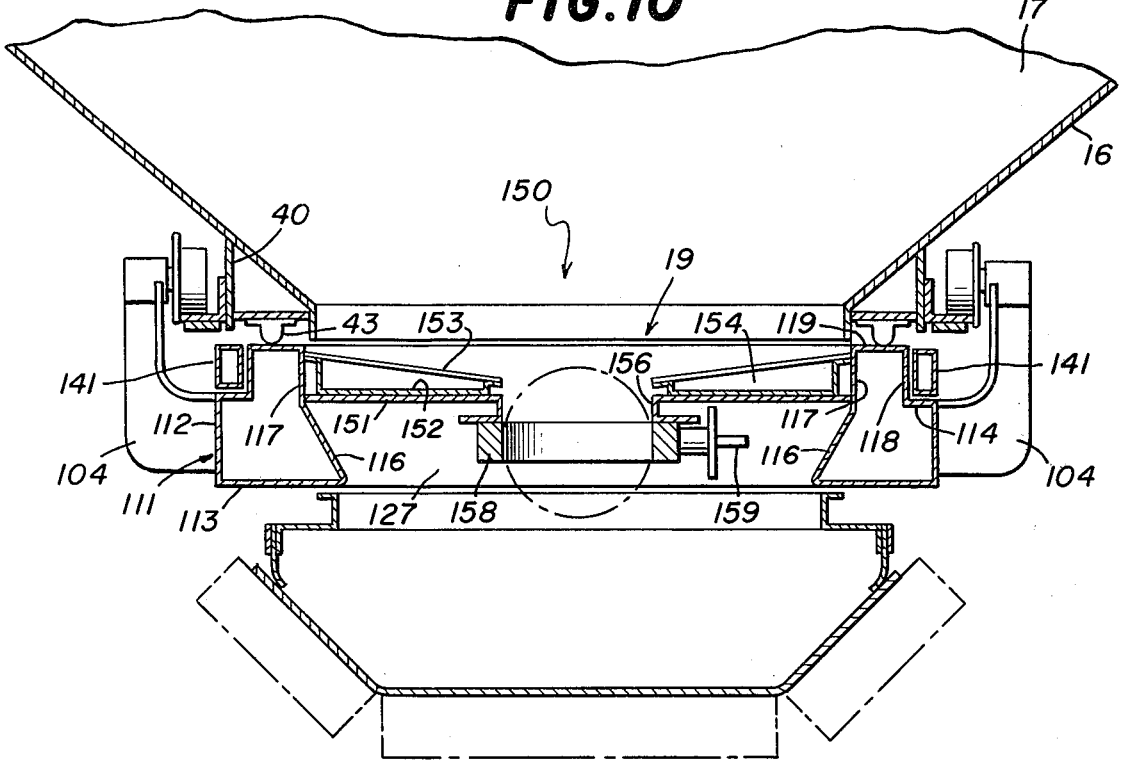
FIG. 10 is a fragmentary view in vertical section taken along the line 10—10 in FIG. 9.
Figure 11:
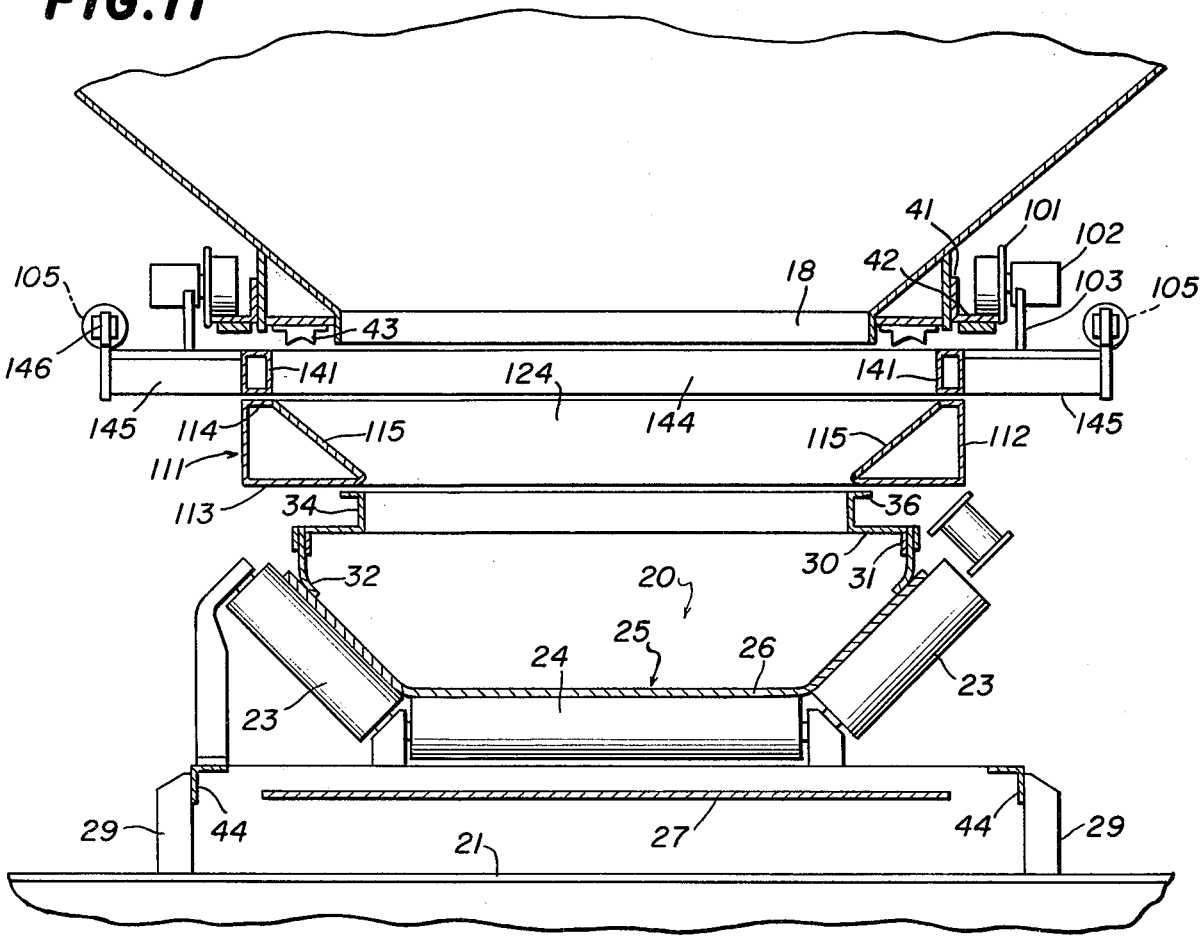
FIG. 11 is a fragmentary view in vertical section taken along the line 11—11 in FIG. 8.

Referring now to FIGS. 7 through 12 of the drawings, there is illustrated another embodiment of the present invention, in which the unloading conveyor 20 is shown supported on short support posts 29, to which are fixedly secured elongated angle irons 44 (see FIG. 11). Except for this modified support arrangement, the unloading conveyor 20 and the associated dust cover 30 are substantially identical to those illustrated in FIGS. 2 through 6.

In this embodiment of the invention, the discharge apparatus includes a gate carriage, generally designated by the numeral 100, which includes four pairs of flanged wheels 101 adapted for rolling engagement with the rail flanges 42. More particularly, each pair of flanged wheels 101 includes two coaxially arranged wheels respectively disposed for engagement with the two rail flanges 42. Each of the wheels 101 is rotatably mounted in a bearing 102, each of the bearings 102 for the two forward pairs of wheels 101 being connected to an associated support bracket 103, and each of the bearings 102 for the two aft pairs of wheels 101 being connected to a support bracket 104. There are also provided two carriage drive cylinders 105, respectively disposed on opposite sides of the gate carriage 100 and extending generally longitudinally of the vessel 10, the drive cylinders 105 being pivotally coupled at their aft ends to the vessel 10 by suitable means (not shown) and being provided with piston rods 106 projecting forwardly therefrom for a purpose to be explained more fully below.

The gate carriage 100 also includes an elongated housing, generally designated by the numeral 110. The housing 110 is rectangular in shape and comprises two laterally spaced-apart parallel hollow side frames 111, a hollow front end frame 120, a hollow rear end frame 125 and a hollow, laterally-extending midframe 130. The side frame 111 cooperate with the front end frame 120 and the midframe 130 to define a generally rectangular vertical passage for discharge of bulk or lump material, and they cooperate with the rear end frame 125 and the midframe 130 to define a generally rectangular vertical passage for discharge of pulverulent material.

More particularly, referring to FIGS. 10 and 11, each of the side frames 111 includes an upstanding side wall 112, a bottom wall 113 and an upper wall 114. Interconnecting the bottom wall 113 and the upper wall 114 along the forward half of the side frame 111 is a downwardly and inwardly sloping inner wall 115 which extends longitudinally from the front end frame 120 to the midframe 130. Each side frame 111 is provided along the aft or rear half thereof with an inclined inner wall 116 which extends upwardly from the inner edge of the bottom wall 113 and is integral at the upper end thereof with a vertically-extending upper side wall 117 (FIG. 10). Integral with the upper wall 114 at the inner edge thereof is an upstanding side wall 118, the side walls 117 and 118 being interconnected at their upper ends by a top wall 119.

The front end frame 120 (see FIGS. 8 and 9) includes a vertical end wall 121 integral at the lower and upper ends thereof, respectively, with horizontal rearwardly extending bottom and upper walls 122 and 123. The bottom wall 122 extends aft further than the upper wall 123 and is connected thereto by a downwardly and inwardly sloping inner wall 124. The rear end frame 125 is substantially rectangular in transverse cross-section and includes outer and inner vertical end walls 126 and 127 interconnected at the lower and upper ends thereof, respectively, by a bottom wall 128 and a top wall 129. The upper wall 123 of the front end frame 120 is substantially coplanar with the upper walls 114 of the side frames 111, and the top wall 129 of the rear end frame 125 is substantially coplanar with the top walls 119 of the side frames 111.

The midframe 130 has an upstanding rear wall 131 and a horizontal bottom wall 132. An inclined wall 133 slopes upwardly and rearwardly from the forward end of the bottom wall 132 and is integral at its upper end with a short upstanding forward wall 134. Interconnecting the upper ends of the rear wall 131 and the forward wall 134 is a horizontal top wall 135 which is substantially coplanar with the top walls 119 of the side frames 111. Also, the bottom walls 113, 122, 128 and 132 are all substantially coplanar. The passage for the lump cargo is defined by the sloping walls 115, 124, and 133, while the passage for the pulverulent material is defined by the walls 116, 117, 127 and 131.

The housing 110 is supported on the rail flanges 42 by means of the support brackets 104. More specifically, each of the support brackets 104 is fixedly secured to the side wall 112 of the adjacent side frame 111 along the aft portion thereof, whereby the housing 110 is supported by the aft two pairs of wheels 101.

Figure 8:
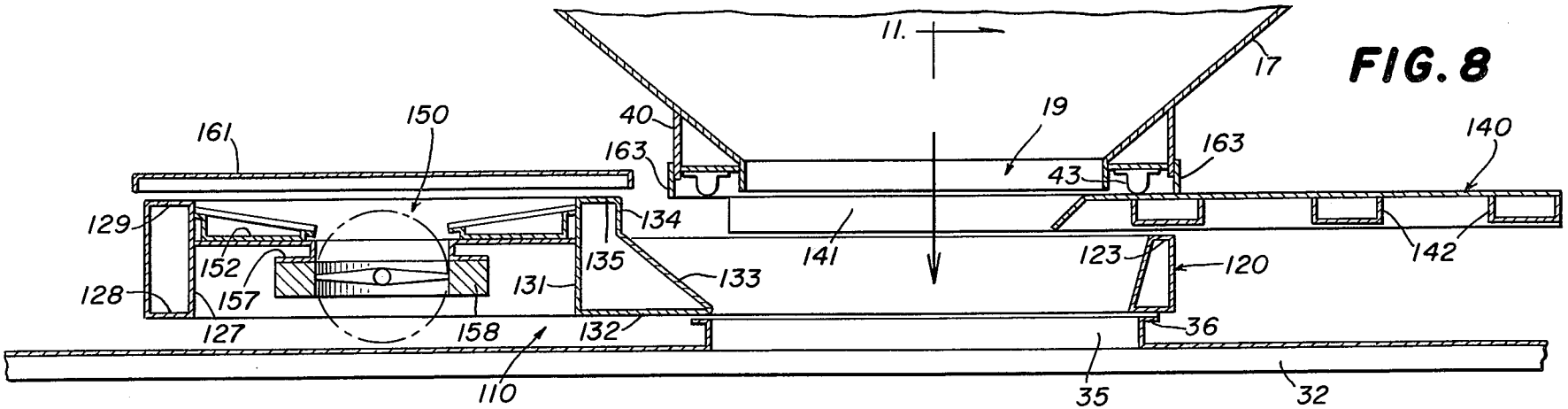
FIG. 8 is a fragmentary view in vertical longitudinal section through the hopper and discharge apparatus of FIG. 7, with the slide gate illustrated in the open position.

The gate carriage 100 also includes a discharge gate 140 which includes a pair of laterally spaced-apart, horizontal, longitudinally extending hollow side frames 141, each being rectangular in transverse cross-section and interconnected adjacent to the forward ends thereof by a plurality of longitudinally spaced-apart and laterally extending cross channels 142 (FIGS. 8 and 9). Spanning the side frames 141 and supported on the cross channels 142 is a rectangular horizontal top plate 143. The top plate 143 extends from the forward end of the side frames 141 about half way to the rear ends thereof and is provided at its rear edge with a downwardly and rearwardly sloping end flange 144. The discharge gate 140 is disposed with the side frames 141 thereof respectively overlying the upper walls 114 of the housing side frames 111, the side frames 141 being fixedly secured to the support brackets 103 for supporting the discharge gate 140 on the front two pairs of wheels 101. Extending laterally outwardly from the side frames 141 at the aft ones of the support brackets 103 are two support members 145, each having an upstanding coupling ear 146 provided with a pivot coupling 147 to the distal end of the corresponding one of the piston rods 106.

Figure 12:
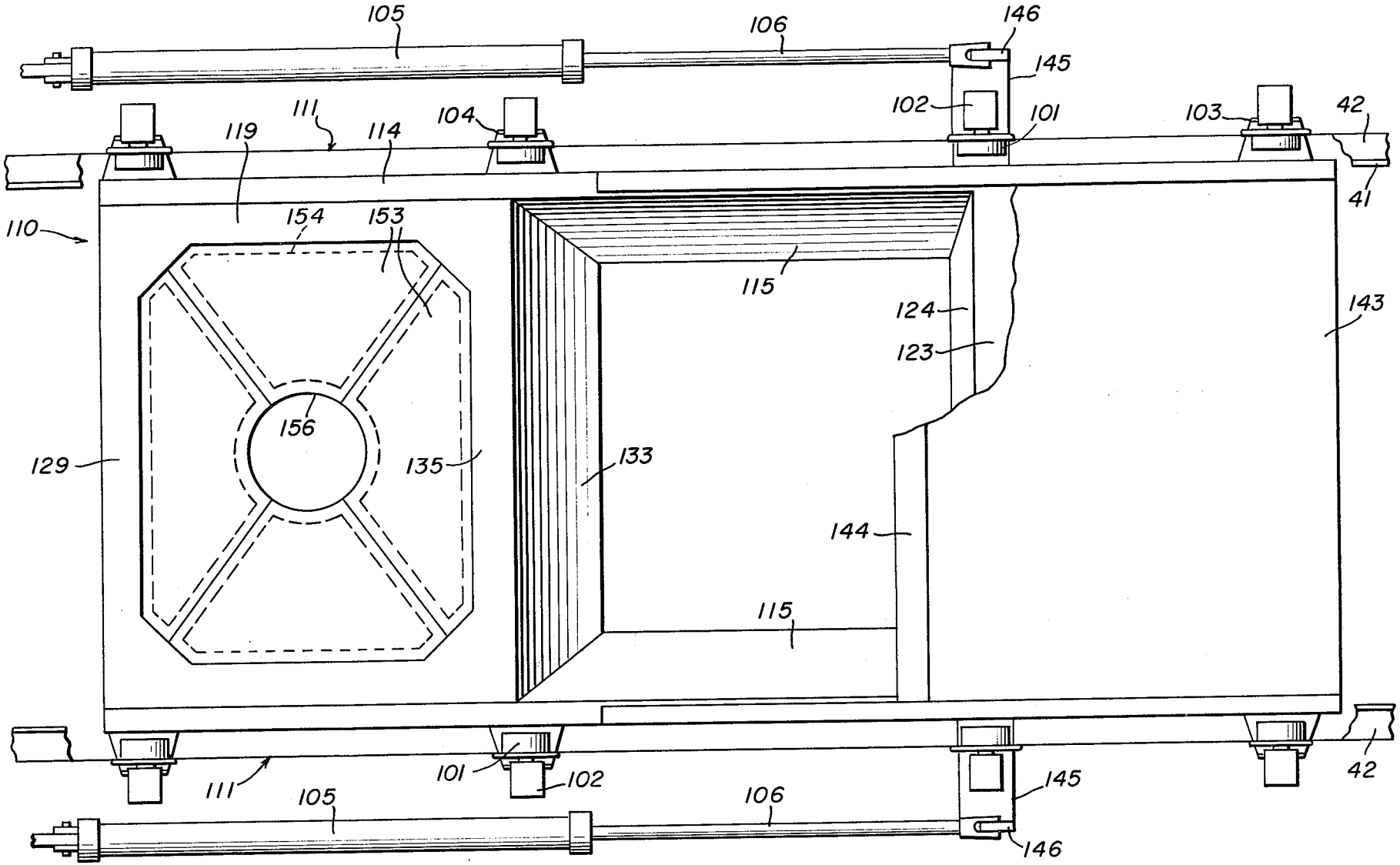
FIG. 12 is a fragmentary top plan view of the discharge apparatus of FIG. 7 with the slide gate shown partially open and with portions of the structure broken away more clearly to illustrate the construction.

The gate carriage 100 also includes a gate assembly 150 (see FIGS. 8–10) disposed within the housing 110. More specifically, the gate assembly 150 includes coplanar attachment flanges 151 extending inwardly from the housing frame walls 117, 137 and 131. Supported on the attachment flanges 151 are generally channel-shaped plenum walls 152, each of which is provided with a downwardly and inwardly sloping airslide plate 153, the airslide plates 153 cooperating with the associated plenum walls 152 to define a plenum 154. The airslide assembly is shown in FIG. 12 in a slightly different configuration than that of FIG. 6, i.e. with truncated corners, but it will be appreciated that any suitable configuration may be used.

Disposed centrally of the gate assembly 150 is a butterfly valve assembly 155. Each of the attachment flanges 151 has an arcuate inner edge, these arcuate inner edges cooperating to define a circular opening. Integral with the inner edges of the attachment flanges 151 and extending downwardly therefrom is a cylindrical flange 156 which defines a vertical passage. Integral with the flange 156 at its lower end is a radially outwardly extending annular attachment flange 157, to the bottom surface of which is fixedly secured an annular valve housing 158. Extending diametrically across the valve housing 158 is a pivot shaft 159 supporting thereon a circular butterfly valve member 160 for rotation between closed and open positions, respectively illustrated in FIGS. 8 and 9, for closing and opening the passage through the cylindrical flange 156 and the valve housing 158.

Disposed adjacent to the hopper 15 just aft thereof is a horizontal dust shield 161 (FIG. 8) disposed for covering the gate assembly 150 when it is not in use. Fixedly secured to the vertical flanges of the angle frames 40 at the forward and aft ends of the hopper 15 and extending downwardly therefrom are two rectangular wipers 163, the lower edges of which are disposed for wiping engagement with the top plate 143 of the discharge gate 140 and with the top walls 119, 129 and 135 of the housing 110, as will be explained more fully below. Pivotally mounted on the side wall 112 of one of the side frames 111 on the forward portion thereof is a latch hook 165 disposed for latching engagement with a pin 166 on the adjacent side frame 141 of the discharge gate 140 (see FIG. 7). While only one latch hook 165 is illustrated, it will be appreciated that latches could be provided on both sides of the gate carriage 100.

In operation, when the cargo in the hopper 15 is pulverulent material, the latch hook 165 is engaged with the pin 166 so that the discharge gate 140 and the frame 110 will move in tandem. Then, the gate carriage 100 is moved, by extension of the piston rods 106, to the position illustrated in FIGS. 9 and 10 wherein the gate assembly 150 is disposed beneath the hopper outlet 19. More particularly, when the piston rod 106 is extended, it rolls the discharge gate 140 forwardly along the rail flanges 42 and, through the operation of the latch hook 165 and pin 166, simultaneously pulls the frame 110 forwardly with it. As the gate assembly 150 moves beneath the hopper 15, the wipers 163 will wipe the top walls 119, 129 and 135 of the frame 110 so that the inflatable seals 43 will have clean seating surfaces. Thus, as can best be seen in FIG. 9, the inflatable seals 43 will cooperate with those top wall surfaces to maintain water tightness between the cargo hold and the conveyor 20.

It will be appreciated that the gate carriage 100 is moved to the position illustrated in FIGS. 9 and 10 prior to loading of the pulverulent material into the cargo hold 12 associated with the hopper 15, and the valve member 160 is initially disposed in its closed horizontal position. The closed valve assembly 155 and the sealing relationship between the housing 110 and the inflatable seals 43 serve to close the hopper outlet 19 and prevent escape of pulverulent material therefrom, as well as effectively preventing water or other fluids from being introduced thereinto. When it is desired to discharge pulverulent material from the hopper 15 to the unloading conveyor 20, pressurized air is introduced to the plenum 154 and the valve member 160 is rotated from its closed position, it being understood that the rate of discharge will be controlled by the degree of opening of the valve assembly 155. The airslide plates 153 provide fluid-activated gravity-flow conveyors to facilitate the flow of pulverulent material to the discharge passage through the valve assembly 155.

Figure 7:
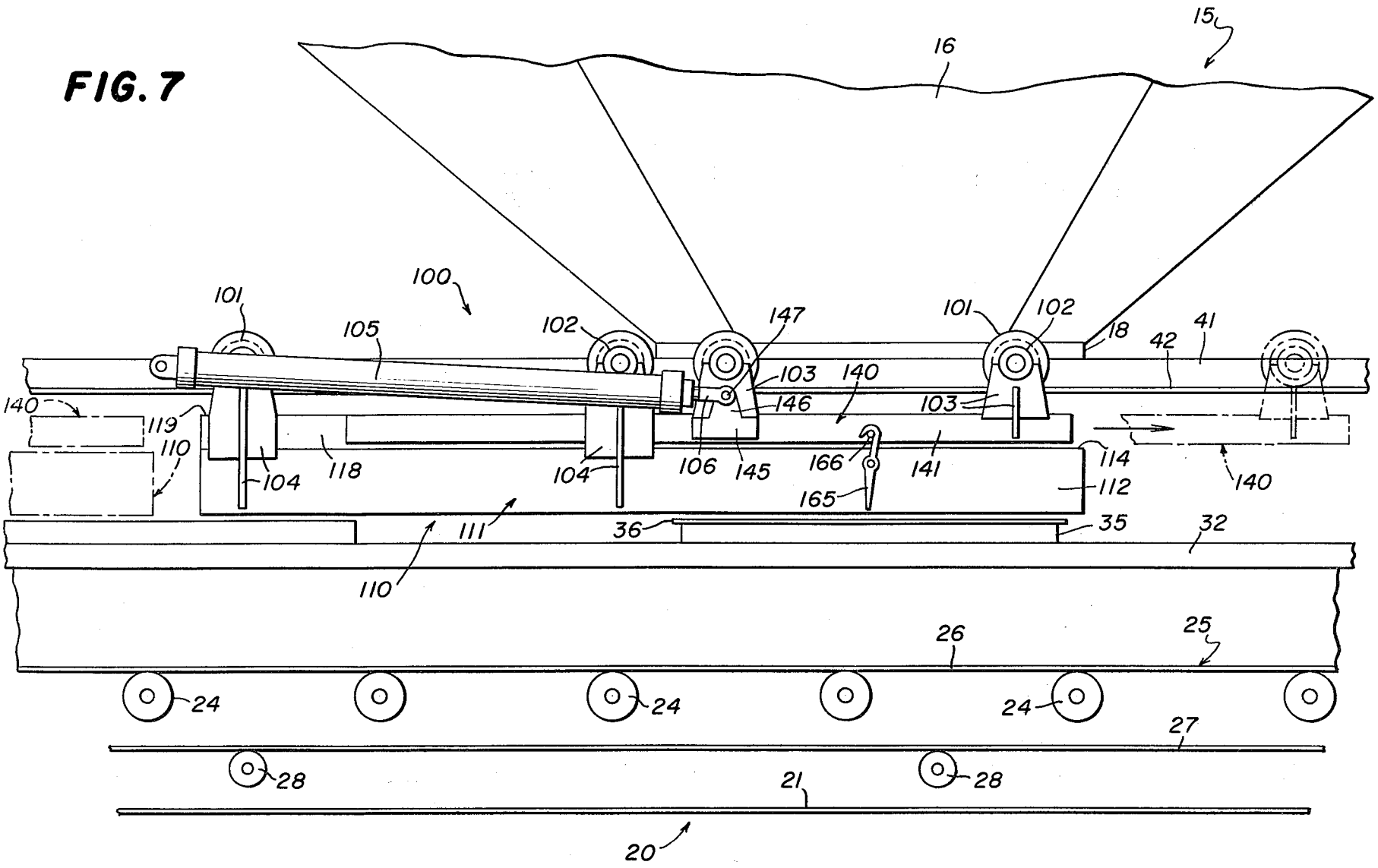
FIG. 7 is an enlarged, fragmentary, side elevational view of a hopper outlet of the vessel of FIG. 1, provided with a discharge apparatus constructed in accordance with and embodying the features of another embodiment of the present invention, and with the discharge apparatus illustrated in position for discharging lump material from the hopper and with the slide gate closed.

When lump material is to be carried in the cargo hold associated with the hopper 15, the gate carriage 100 is moved, by a retraction of the piston rods 106 to the position illustrated in FIGS. 7, 8 and 11, wherein the discharge gate 140 is disposed beneath the hopper outlet 19, and the gate assembly 150 is disposed beneath the dust shield 161. During this movement of the housing 110, the wipers 163 will clean the top plate 143 of the discharge gate 140 so that the inflatable seals 43 will have a clean seating surface thereon. However, once the frame 110 has been moved to the lump cargo unloading position illustrated in FIG. 7, the seals 43 are preferably deflated, as illustrated in FIG. 11. The latch hook 165 is then disengaged from the pin 166.

When it is desired to discharge the lump material from the hopper 15, the discharge gate 140 is moved toward the right, as viewed in FIG. 7, by extension of the piston rods 106. It will be appreciated that the rate of flow of lump material from the hopper 15 may be controlled by the degree of opening of the discharge gate 140, the discharge gate 140 being illustrated in a partially open position in FIG. 12. Since the discharge gate 140 is disconnected from the frame 110, the frame 110 will remain stationary during the opening and closing of the discharge gate 140. For this purpose, additional latch means (not shown) may be provided to pin the frame 110 in its aft position illustrated in FIG. 7 during the unloading of lump material from the hopper 15.

It is to be understood that the drive cylinders 55, 57 and 105, the valve assemblies 90 and 155 and the airslide mechanisms of the present invention can be manually or automatically controlled. Furthermore, it will be appreciated that control means may be provided so that the discharge apparatus for each hopper 15 may be controlled independently of or in unison with the discharge apparatus for any number of other hoppers.

From the foregoing, it can be seen that there has been provided an improved dual-function discharge apparatus for a self-unloading vessel which is capable of handling both pulverulent and lump-type material, and which permits movement of two different gate assemblies in tandem by a single gate carriage mechanism for discharge of either lump or pulverulent material to a single unloading conveyor.

What is claimed is:

1. Discharge apparatus for discharge of lump material as well as pulverulent material from a hopper having a discharge outlet, said discharge apparatus comprising: a carriage mounted adjacent to the hopper outlet and movable between first and second positions, first gate means associated with said carriage and movable independently thereof for handling lump material, second gate means mounted on said carriage and movable for handling pulverulent material, said first gate means being movable for cooperation with the hopper outlet to control the discharge of lump material therefrom when said carriage is stationary in the first position thereof, said second gate means being movable for cooperation with the hopper outlet to control the discharge of pulverulent material therefrom when said carriage is stationary in the second position thereof, and drive means coupled to said carriage for effecting movement thereof between the first and second positions thereof.

2. The discharge apparatus of claim 1, wherein said drive means includes a fluid-actuated cylinder.

3. The discharge apparatus of claim 1, wherein said first gate means includes a horizontal gate member slidably movable between open and closed conditions with respect to the hopper outlet, said second gate means including a gate member rotatably movable between open and closed conditions with respect to the hopper outlet.

4. The discharge apparatus of claim 1, and further including means providing a fluid-tight seal between the hopper and said first and second gate means.

5. The discharge apparatus of claim 4, wherein said seal means comprises inflatable seal members.

6. The discharge apparatus of claim 1, wherein said second gate means includes means defining a discharge passage, and fluid-activated gravity flow means for facilitating the flow of pulverulent material from the hopper to said discharge passage.

7. The discharge apparatus of claim 1, and further including a pair of elongated rails respectively disposed on opposite sides of the hopper, said carriage including two sets of flanged wheels respectively arranged for rolling engagement with said rails.

8. Unloading apparatus for unloading lump material as well as pulverulent material from a hopper having a discharge outlet said unloading apparatus comprising: an unloading conveyor positioned in underlying relation to the hopper outlet, a carriage mounted adjacent to the hopper outlet and movable between first and second positions, first gate means associated with said carriage and movable independently thereof for handling lump material, second gate means mounted on said carriage and movable for handling pulverulent material, said first gate means being disposed between the hopper outlet and said unloading conveyor and movable for cooperation with the hopper outlet to control the discharge of lump material therefrom to said unloading conveyor when said carriage is stationary in the first position thereof, said second gate means being disposed between the hopper outlet and said unloading conveyor and movable for cooperation with the hopper outlet to control the discharge of pulverulent material therefrom to said unloading conveyor when said carriage is stationary in the second position thereof, and drive means coupled to said carriage for effecting movement thereof between the first and second positions thereof.

9. The unloading apparatus of claim 8, wherein said conveyor comprises an endless belt conveyor.

10. The unloading apparatus of claim 9, and further including retaining means associated with said belt conveyor for confining thereon material discharged thereto from the hopper.

11. The unloading apparatus of claim 9, and further including control means responsive to a predetermined depth of discharged material on said conveyor for causing the operative one of said gate means to reduce the rate of discharge therethrough.

12. Discharge apparatus for discharge of lump as well as pulverulent material from a hopper having a discharge outlet, said discharge apparatus comprising: a carriage mounted adjacent to the hopper outlet and movable between first and second positions, discharge housing means mounted on said carriage and defining first and second discharge passages therethrough respectively adapted for handling lump material and pulverulent material, gate means associated with said discharge housing means and adapted for horizontal sliding movement independently of said carriage between a closed condition closing said first discharge passage and an open condition opening said first discharge passage and accommodating maximum flow of lump material therethrough, valve means associated with said discharge housing means and rotatably movable between a closed condition closing said second discharge passage and an open condition opening said second discharge passage and accommodating maximum flow of pulverulent material therethrough, said first discharge passage communicating with the hopper outlet and said discharge housing means cooperating with the hopper so that movement of said gate controls the discharge of lump material from the hopper when said carriage is stationary in the first position thereof, said second discharge passage communicating with the hopper outlet and said discharge housing means cooperating with the hopper so that movement of said valve controls the discharge of pulverulent material from the hopper when said carriage is stationary in the second position thereof, and drive means coupled to said carriage for effecting movement thereof between the first and second positions thereof.

13. The discharge apparatus of claim 12, and further including means providing a fluid-tight seal between the hopper and said discharge housing means.

14. The discharge apparatus of claim 13, and further including gate seal means providing a fluid-tight seal between said gate means and said discharge housing.

15. The discharge apparatus of claim 12, wherein said discharge housing means includes a first discharge housing defining said first discharge passage, and a second discharge housing defining said second discharge passage, said first and second discharge housings being movable with respect to each other.

16. The discharge apparatus of claim 15, wherein said gate means is coupled to said second discharge housing for movement therewith.

17. The discharge apparatus of claim 15, and further including second drive means coupled to said gate means for effecting movement thereof between the open and closed conditions thereof.

18. Th discharge apparatus of claim 12, wherein said discharge housing means comprises a single housing defining both of said first and second discharge passages therethrough.

19. The discharge apparatus of claim 18, and further including means releaseably coupling said gate means to said housing, said housing being movable with said gate means when coupled thereto and said gate means being movable with respect to said housing when decoupled therefrom.

20. The discharge apparatus of claim 19, wherein said drive means is coupled to said gate means.

21. The discharge apparatus of claim 19, and further including a pair of elongated rails respectively disposed on opposite sides of the hopper, said carriage including four pairs of flanged wheels with the wheels of each pair respectively arranged for rolling engagement with said rails, two pairs of said wheels being coupled to said housing and the other pairs of said wheels being coupled to said gate means.

22. The discharge apparatus of claim 1, and further including gate drive means mounted on said carriage and coupled to said first gate means for effecting movement thereof between the open and closed conditions thereof.

23. The discharge apparatus of claim 22, wherein said first gate means includes a flat plate disposed substantially horizontally in use and adapted for horizontal sliding movement between the open and closed conditions of said first gate means.

24. The discharge apparatus of claim 22, wherein said gate drive means includes a fluid-actuated cylinder.

25. The discharge apparatus of claim 22, and further including a pair of elongated rails respectively disposed on opposite sides of the hopper, said carriage including two sets of flanged wheels respectively arranged for rolling engagement with said rails.

26. The discharge apparatus of claim 25, and further including gate support means including a pair of elongated second rails respectively disposed on opposite sides of the hopper, support members connected to said gate means, and flanged wheels carried by said support members for rolling engagement with said second rails.

27. Discharge apparatus for discharge of lump as well as pulverulent material from a hopper having a discharge outlet, said discharge apparatus comprising: a carriage mounted adjacent to the hopper outlet and movable between first and second positions, first gate means associated with said carriage for movement independently thereof between open and closed conditions and adapted for handling lump material, second gate means mounted on said carriage for movement between open and closed conditions and adapted for handling pulverulent material, said first gate means being movable for cooperation with the hopper outlet to control the discharge of lump material therefrom when said carriage is stationary in the first position thereof, said second gate means being movable for cooperation with the hopper outlet to control the discharge of pulverulent material therefrom when said carriage is stationary in the second position thereof, gate drive means coupled to said first gate means for effecting movement thereof between the open and closed conditions thereof, and means releaseably coupling said first and second gate means together so that said second gate means moves with said first gate means when coupled thereto and said first gate means moves with respect to said second gate means when decoupled therefrom.

* * * * *